US006687570B1

(12) United States Patent
Sussmeier et al.

(10) Patent No.: US 6,687,570 B1
(45) Date of Patent: Feb. 3, 2004

(54) STATION INDEPENDENT BUFFER TRANSPORT FOR AN INSERTER SYSTEM

(75) Inventors: John W. Sussmeier, Cold Spring, NY (US); Gregory P. Skinger, Southbury, CT (US); John R. Masotta, Milford, CT (US); William J. Wright, Killingsworth, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/329,031

(22) Filed: Dec. 24, 2002

(51) Int. Cl.[7] ..... G06F 7/00

(52) U.S. Cl. ..... 700/220; 700/223; 700/228; 271/272; 271/3.2; 271/265.02; 271/189; 270/58.02; 270/52.09

(58) Field of Search ..... 700/219, 220, 700/223, 228, 230; 271/272, 3.2, 3.24, 7, 256, 265.02, 265.03, 266, 69, 189; 270/52.01, 58.01, 59, 58.02, 52.09

(56) References Cited

U.S. PATENT DOCUMENTS 5,110,115 A * 5/1992 Couper ..... 271/265.02
5,465,955 A * 11/1995 Krupica et al. ..... 271/265.02
5,826,157 A * 10/1998 Wierszewski ..... 399/396
5,848,784 A * 12/1998 Tranquilla ..... 271/10.03
6,062,557 A * 5/2000 Kusumi ..... 271/10.13
6,131,053 A * 10/2000 Nyffenegger et al. ..... 700/220
6,378,687 B1 * 4/2002 Lem et al. ..... 198/349.95
6,488,279 B1 * 12/2002 Fukuda et al. ..... 271/314

* cited by examiner

*Primary Examiner*—Patrick Mackey
(74) *Attorney, Agent, or Firm*—Michael J. Cummings; Charles R. Malandra, Jr.; Angelo N. Chaelns

(57) ABSTRACT

A flexible buffer transport system for staging accumulated documents for transfer to a synchronous downstream transport. Control of movement of accumulations in the buffer being independent of the length of the documents. The system includes a plurality of roller nips in series. The roller nips are spaced a uniform distance apart. Each of the roller nips are driven by an independently controllable motor in communication with a controller. Position sensors also communicate with the controller. The sensors sense positions of lead and trail edges of accumulations of documents within the buffer transport system. For each sampling period in the operating cycle and for each roller nip, the controller determines motion control. First, the controller determines which nips should be slaved together based on which are needed to control a particular accumulation of documents under its control. The motion of the roller nips are also controlled in accordance with a predetermined algorithm to bring a lead edge of an accumulation within a predetermined gap distance from a trail edge of a downstream accumulation.

18 Claims, 3 Drawing Sheets

STATION INDEPENDENT BUFFER TRANSPORT FOR AN INSERTER SYSTEM

TECHNICAL FIELD

The present invention relates to a buffer transport module in a high speed mass mail processing and inserting system. The buffer transport provides a staging area for transferring asynchronously produced accumulations of documents generated by the inserter input subsystem to the synchronous transport of the inserter chassis. The buffer transport further provides "parking spots" for accumulations of documents that are already in progress of being created when downstream modules stop.

BACKGROUND OF THE INVENTION

Inserter systems, such as those applicable for use with the present invention, are typically used by organizations such as banks, insurance companies and utility companies for producing a large volume of specific mailings where the contents of each mail item are directed to a particular addressee. Also, other organizations, such as direct mailers, use inserts for producing a large volume of generic mailings where the contents of each mail item are substantially identical for each addressee. Examples of such inserter systems are the 8 series, 9 series, and Advanced Productivity System (APS™) inserter systems available from Pitney Bowes Inc. of Stamford Connecticut.

In many respects, the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mail piece is produced. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

The input stages of a typical inserter system are depicted in FIG. 1. At the input end of the inserter system, rolls or stacks of continuous printed documents, called a "web," are fed into the inserter system by a web feeder 10. The continuous web must be separated into individual document pages. This separation is typically carried out by a web cutter 20 that cuts the continuous web into individual document pages. Downstream of the web cutter 20, a right angle turn 30 may be used to reorient the documents, and/or to meet the inserter user's floor space requirements.

The separated documents must subsequently be grouped into collations corresponding to the multi-page documents to be included in individual mail pieces. This gathering of related document pages occurs in the accumulator module 40 where individual pages are stacked on top of one another.

The control system for the inserter senses markings on the individual pages to determine what pages are to be collated together in the accumulator module 40. In a typical inserter application, mail pieces may include varying number of pages to be accumulated. For example, the phone bill for a person who lives by himself may be much shorter than the another phone bill representing calls made by a large family. It is this variation in the number of pages to be accumulated that makes the output of the accumulator 40 asynchronous, that is, not necessarily occurring at regular time intervals.

Downstream of the accumulator 40, a folder 50 typically folds the accumulation of documents, so that they will fit in the desired envelopes. To allow the same inserter system to be used with different sized mailings, the folder 50 can typically be adjusted to make different sized folds on different sized paper. As a result, an inserter system must be capable of handling different lengths of accumulated and folded documents.

Downstream of the folder 50, a buffer transport 60 transports and stores accumulated and folded documents in series in preparation for transferring the documents to the synchronous inserter chassis 70. By lining up a back-log of documents in the buffer 60, the asynchronous nature of the upstream accumulator 40 will have less impact on the synchronous inserter chassis 70. For example, if a particularly long phone bill were being formed in the accumulator 40, a larger than normal gap might form with the preceding document. However, this gap will not have an affect on synchronous placement of documents on the chassis 70 because the buffer 60 preferably includes enough documents that the longer document can "catch up" before its turn to be placed on the synchronous chassis 70.

Another important function of the buffer 60 is its ability to "park" document accumulations when the chassis 70 is stopped, or otherwise unable to accept documents. When the chassis 70 must be stopped, for example as a result of a jam, a signal is typically sent to the web feeder 10 and web cutter 20 to cease operating. However, pages that are already in the process of being cut, or that are in the right angle turn 30, or in the folder 50, need a place to come to rest. Such components in the inserter input stage run all the time, and do not have the capability of halting part-way through their processes.

The accumulator 40 typically provides one or two parking spots, or stopping stations, for such documents that are "in progress." However, documents in the accumulator 40 may have to be sent downstream to make room for further "in progress" documents from upstream. When the chassis 70 is stopped, there must be at least enough stopping stations in the buffer 60 and accumulator 40 to accept all of the "in progress" documents and pages. In particular, when the mail pieces are comprised of shorter numbers of pages, more stopping stations may be needed because more document accumulations result from the same number of pages being cut.

Accordingly, it is desirable that the buffer 60 be designed to include enough stopping stations to satisfy the parameters of the accumulation lengths and page counts as required by the inserter user.

In the prior art buffer depicted in FIG. 2, six stopping stations are provided over a forty-two inch buffer length. The space within each stopping station being seven inches. Each of the prior art stopping stations, 1, 2, 3, 4, 5, and 6, includes a roller nip 14. When a document accumulation must stop at a stopping station, the respective roller nip 14 is stopped. When it is time for a document accumulation to move to the next stopping station, the respective roller nip 14 drives the accumulation downstream.

The seven inch spacing between roller nips 14 is longer than the typical document accumulation to be transported.

Accordingly, a mechanism for moving accumulations between roller nips 14 is provided. This mechanism is comprised of o-ring belts 13 that are driven around the length of the buffer transport system by rollers 12. These o-ring belts 13 and rollers 12 run continuously and provide for transportation of accumulations between roller nips 14 at different stopping stations. The o-ring belts 13 continue to run even when one or more of the stopping stations and respective roller nips 14 are stopped. When an accumulation is stopped at the roller nips 14, the o-ring belts 13 slip over and under the accumulations. Accordingly, the tension of the o-ring belts 13 is light, and the surfaces in contact with the accumulations have low friction. As such, rollers 12 and belts 13 are incapable of implementing any control over the stopping and starting of movement of documents in the buffer. Rather, control of the relative movement of documents within the buffer is provided by the roller nips 14.

The roller nips 14 are controlled in accordance with predetermined rules for moving documents within the buffer. When a sensor 11 detects an accumulation within a first stopping station, a decision must be made about what to do with it. Accordingly, when a downstream accumulation is detected in the immediate downstream stopping station, then the accumulation is held in the first stopping station. If there is no accumulation in the immediate downstream stopping station, then the roller nip 14 moves the accumulation downstream to the next station. This logic is used for each of the stopping stations 1–6 for every period in the control cycle. Accordingly, documents are generally shifted towards the downstream end of the buffer as stations become available.

SUMMARY OF THE INVENTION

While the prior art system described above often performs satisfactorily, the forty two inch buffer length and seven inch stopping station length are often longer than necessary to handle documents being processed. While these dimensions might be necessary to handle the longest documents to be handled by the inserter system, a more typical letter sized page folded into thirds would be roughly four inches long. Many accumulations are shorter still.

Accordingly, the prior art arrangement shown in FIG. 2, often uses more floor space than necessary for a given mail piece creation job. Floor space being an important consideration for large pieces of equipment such as inserters, it is desirable to achieve the same (or greater) functionality in less space.

Another shortcoming of the arrangement in FIG. 2, occurs if more stopping stations are desired to provide more parking spaces for a user who wants to run a job with accumulations having low page counts and short documents. In this situation, there is no way to advantageously use the additional space available in the conventional buffer. The conventional buffer is configured to provide a fixed number of stopping stations for fixed maximum length documents, and this configuration cannot be easily adjusted. As cutters and feeders increase in speed, there may be a need for more stopping stations, particularly when a job includes low page count mail pieces. Thus, the "parking" purpose of the buffer becomes more significant to sustain increases in system throughput performance.

The present invention provides a solution to these shortcomings by providing a more flexible buffer transport system that can use the available length of the buffer transport to more efficiently meet the particular needs of a given mail piece job run.

Accordingly, the present invention is a flexible buffer transport system for staging accumulated documents. The control of movement of the accumulations in the buffer is independent of the length of the documents. The number of conceptual stopping stations may be determined by the length of the buffer transport divided by the sum of a document length and the desired gap between document accumulations.

The system includes a plurality of roller nips in series. The roller nips are spaced a uniform distance apart, the uniform distance being close enough to transfer minimum length accumulated documents between consecutive roller nips. Each of the roller nips are driven by an independently controllable motor in communication with a controller.

A plurality of sensors also communicate with the controller. Preferably, at least one sensor is located within the uniform distance between consecutive roller nips. The sensors sense positions of lead and trail edges of accumulations of documents within the buffer transport system.

The controller for the buffer transport system operates on a periodic operating cycle. For each sampling period in the operating cycle and for each roller nip, the controller determines individual nip movement based on predetermined algorithms. First, the controller determines which other nips that the nip under consideration will be operatively slaved with. The slaving of nips together is based on which are needed to control a particular accumulation of documents under its control. The motion of the roller nip is further controlled in accordance with a predetermined algorithm to bring a lead edge of the particular accumulation within a predetermined gap distance from a trail edge of a downstream accumulation of documents in the buffer transport. For the most downstream group of slaved nips, accumulations of documents are transferred to the downstream synchronous transport based on the availability of openings on the synchronous transport.

Further details of the present invention are provided in the accompanying drawings, detailed description and claims.

DETAILED DESCRIPTION

Figure 3:
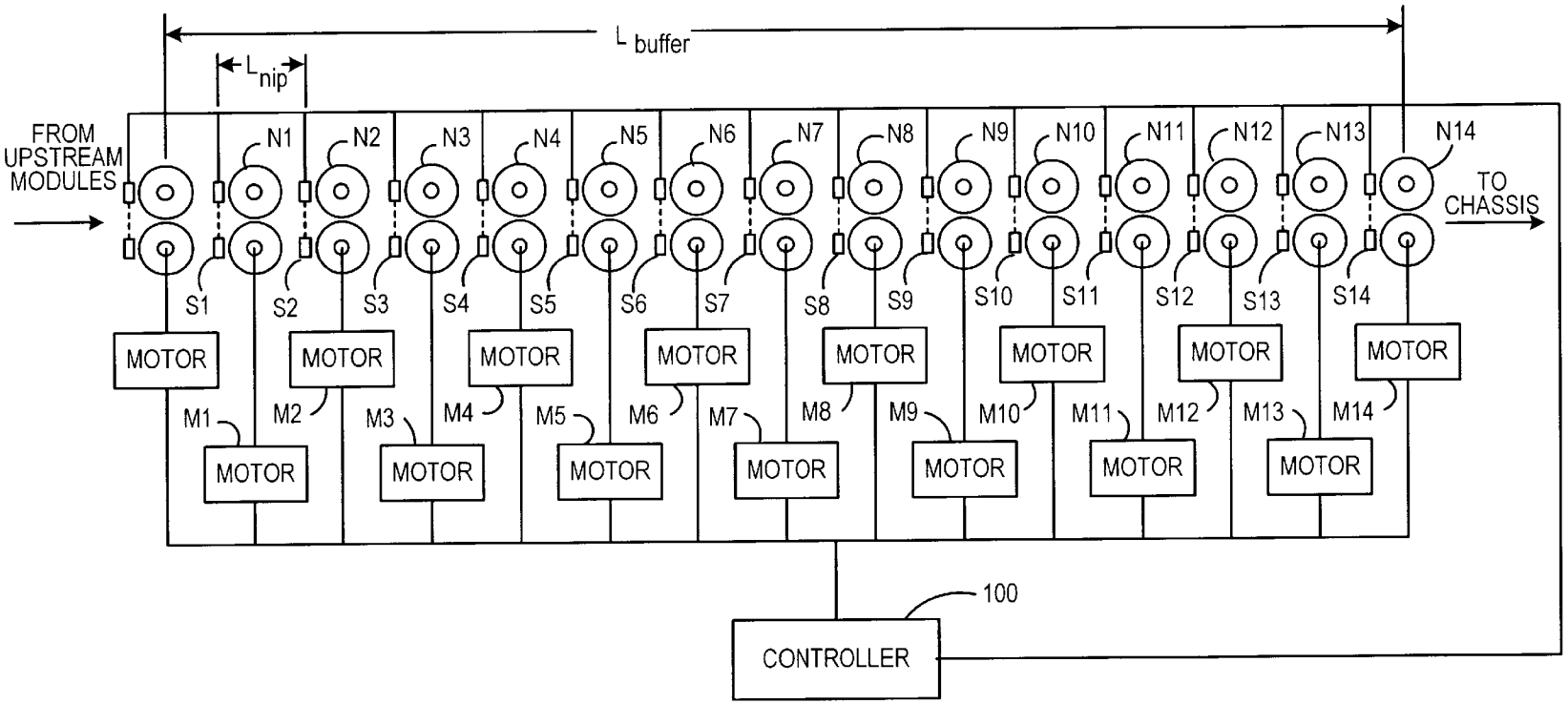
FIG. 3 depicts a preferred buffer transport in accordance with the present invention.

FIG. 3 provides a schematic representation of a preferred buffer transport in accordance with the present invention. The buffer transport is comprised of a plurality of roller nips N, separately marked N1–N14. Each of the roller nips is independently driven by a servo motor M, respectively marked M1–M14, in correspondence with the fourteen roller nips N. The motors M are controlled by controller 100. Controller 100 provides the control for the movement of the individual nips N in the system. Preferably, the motors M include encoders to provide pulses to the controller 100 to further monitor the displacement and position of documents in the system. Since encoder pulses from the motors M results in a corresponding known displacement, downstream positions of documents can be derived if a starting point is known. In addition, the controller 100 preferably provides periodic displacement commands to the motors M to control the motion of the documents within the roller nips N.

The servo motors M for use with the present invention are preferably capable of a velocity of 100 inches per second, and 8.6 G's of acceleration. These capabilities will allow the buffer transport to support inserter system throughput speeds up to 18,000 mail pieces per hour.

The consecutive roller nips N are preferably spaced apart a distance sufficient that they may successfully pass the smallest length accumulation of documents from on nip to another. In a preferred embodiment, this distance, $L_{nip}$, may be approximately two and a half inches. Accordingly, the entire buffer having nips N1–N14 would be thirty-five inches long.

The number of accumulations that may be "parked" in the buffer transport is determined by dividing the entire length of the buffer, $L_{buff}$, by the sum of the length of the documents, $L_{doc}$, and the minimum gap distance allowable, g, between document accumulations. Effectively the number of parking spaces (NP) may be expressed as $NP=L_{buff}/(L_{doc}+g)$, rounded down to an integer value. Accordingly if the downstream chassis comes to rest, NP will be the number of collations that can be provided from the upstream input modules before they must stop generating collations (ignoring parking spots in the accumulator 40).

Figure 1:
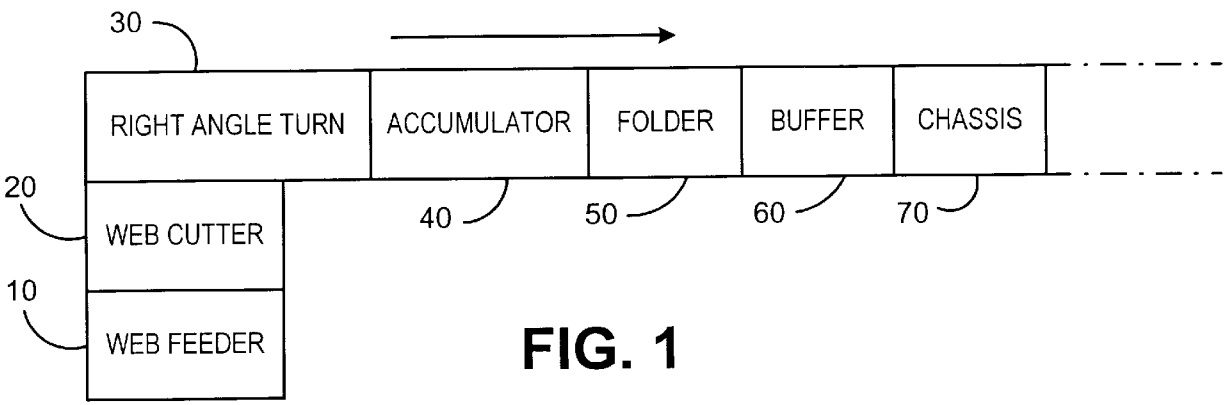
FIG. 1 is a diagram of the input stages of an inserter system for use with the present invention.
Figure 2:
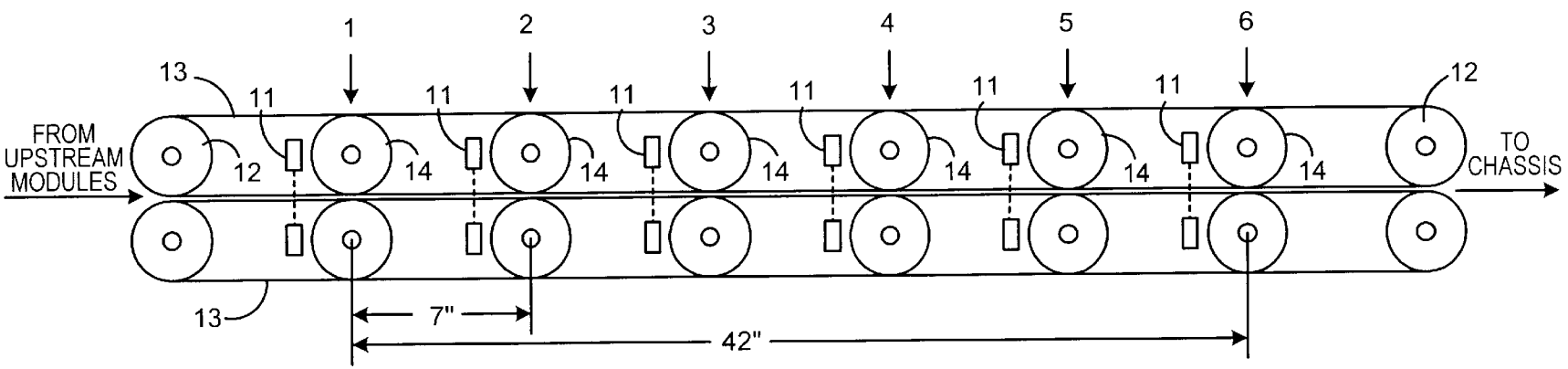
FIG. 2 (PRIOR ART)
FIG. 2 depicts a prior art buffer transport.

For example, in the preferred embodiment where the consequtive roller nips N are spaced apart by two and a half inches, $L_{buff}$ will be 35 inches. If a document length of four inches and gap of one inch is selected, the above equation yields that seven parking spots will be available. Thus for this particular example, more "stations" for parking accumulations are available in the thirty-five inch buffer, than the six stopping stations in the forty-two inch buffer of the prior art, as depicted in FIG. 2. If a six inch document length is selected, however, it can be seen that this particular advantage of the present invention is lost, as only five parking spots will be available. Accordingly, more sets of roller nips N may be desirable for situations where it is known that greater numbers of parking spots will be needed for longer documents.

Along the length of the buffer transport, sensors S detect the lead and trail edges of accumulations traveling in the buffer transport. Preferably, there is at least one sensor S per roller nip N, as depicted by S1–S14 in FIG. 3. In that embodiment, the individual sensors are located at, or in close proximity, to the roller nips N. The sensors S are preferably optical sensors providing signals to the controller 100 providing positions of the passing edges of accumulated documents. Based on these sensor signals, the controller 100 can determine what roller nips N are in control of accumulations, where documents are in relation to one another, and to provide instructions accordingly.

The accumulation location information provided by the sensors may be further supplemented by the controller 100 by taking into account the encoder displacements from motors M. Such encoder displacements can provide document positions subsequent in time to signals from a particular sensor S indicating the presence of a lead or trail edge. In one alternative embodiment, sensors S may be used at alternate roller nips N, instead of every one, as shown in FIG. 3. In this embodiment, the controller 100 may rely more heavily on the encoder information gathered from the motors M for document position determinations.

The controller 100 individually controls each of the motors M to maximize the space usage within the buffer transport by driving each document accumulation to a predetermined distance from the next downstream accumulation. This control scheme is carried out in a recurring operational cycle. Controller 100 performs calculations and provides instructions for each roller nip N, during each sample period in the operational cycle.

In the preferred embodiment, the servo motors M are controlled via commands from controller 100 directing a particular displacement to occur during the sample period. The servo motors M have built-in properties of maximum velocity, maximum acceleration, and maximum deceleration. These properties limit the displacement that can be achieved during any given sample period. Further, in the preferred mode for control under the present invention, the servo motors M typically operate to achieve the desired displacement by (1) accelerating at the maximum acceleration, (2) maintaining the maximum velocity, (3) decelerating at the maximum deceleration, or (4) remaining at rest.

As mentioned above, for each sampling period in the operational cycle, the controller 100 takes account of several parameters and performs a number of calculations. A first parameter is $X_{gapt}$, the actual gap between consecutive documents at the sampling period, t. $X_{gapt}$ is measured from the input the sensors S indicating the positions of the accumulations in the buffer transport. The controller 100 may also preferably supplement the sensor information with displacements measured from the servo motor M encoders. Such encoder information provides the displacement of the document that has occurred subsequent to the sensors'detection of documents' lead or trail edges.

Relevant parameters are summarized as follows:

a=the maximum acceleration of a buffer nip (a positive value);

d=the maximum deceleration of a buffer nip (a negative value);

$V_{max}$=the maximum velocity of a buffer nip $X_{gapt}$=(as described above) the actual gap between documents at sampling period t, $V_{ft}$=the commanded velocity of the downstream document at sampling period, t.

During each sampling period, the controller 100 calculates the difference between the actual gap, $X_{gapt}$, and the desired predetermined gap, g. This calculation may be expressed as:

$$X_t=X_{gapt}-g.$$

The controller 100 also calculates the displacement that would be required to decelerate from the current velocity, $V_t$, to the velocity of the downstream document, $V_{ft}$. This deceleration displacement, $X_{decelt}$, is significant because it would be undesirable to overshoot the desired gap, and possibly crash into the downstream accumulation. This calculation of $X_{decelt}$ utilizes the maximum deceleration, d, of the buffer nip, but any other deceleration to be used may be substituted into the equation:

$$X_{decelt}=(Vft^2-Vt^2)/(2*d).$$

Based on these parameters and calculated values, for each sampling period, the following logic is used to determine the acceleration, $A_t$, to be applied the motors M to achieve the desired displacement for that sampling period. If the roller nip is moving, and the actual gap between documents is equal to, or less than, the distance required to decelerate from the current velocity to the velocity of the downstream document, then the controller will command the motor M to decelerate at the maximum deceleration, d. This logic is directed towards preventing the document from encroaching on the desired gap, or from crashing into the downstream document.

If this first set of conditions is not present, then a next set of conditions is tested. If the actual gap between documents is greater than the distance required to decelerate from the current velocity to the velocity of the downstream document, and the current velocity is less than the maximum velocity, then motor M is commanded to accelerate at the maximum acceleration, a. This logic is designed to bring the document to the predetermined gap distance as quickly as possible.

Finally, if neither of the above sets of conditions are met, there is no acceleration or deceleration of the document, and the current velocity remains constant.

These logic steps may be expressed as follows:

If $(X_i)<=X_{decelt})$ And $(V_i>0)$ $A_i=d;$

Elself $(X_i>X_{decelt})$ And $(V_i<V_{max})$ $A_i=a;$

Else $A_i=0$.

As a result of the logic described herein, the document is continuously driven to a position where it is upstream of the downstream document by the predetermined gap distance, g.

Figure 4:
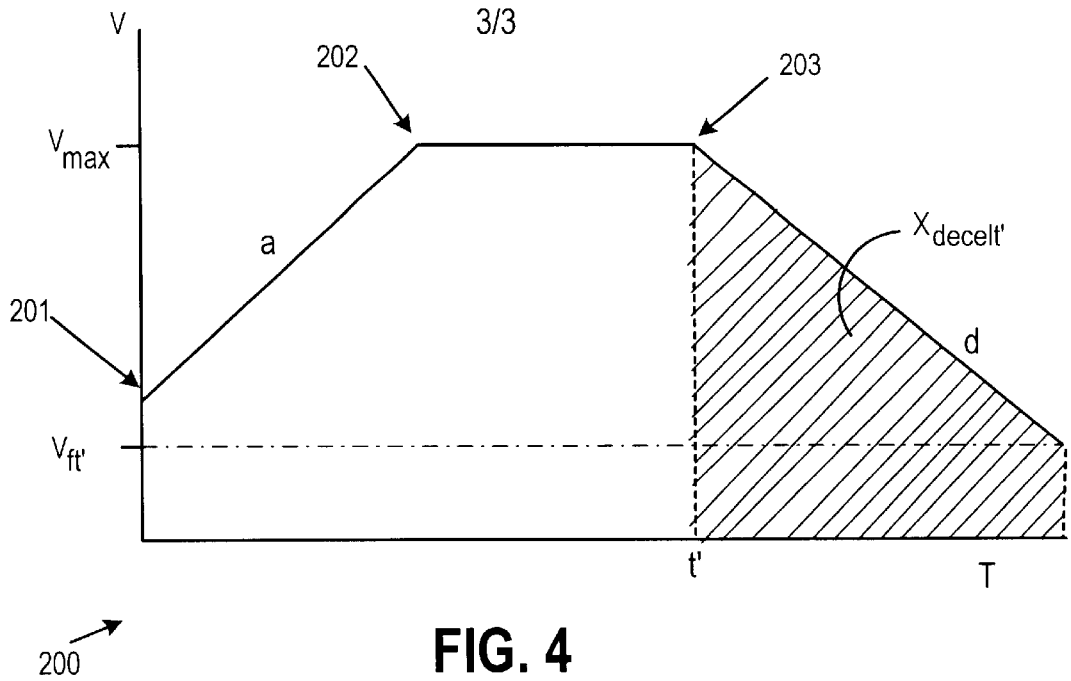
FIG. 4 depicts an exemplary motion profile for a document accumulation as its motion is controlled in accordance the present invention.

An exemplary motion profile for a document controlled in accordance with this motion control logic is depicted in FIG. 4. The vertical axis of profile 200 is the speed of a document traveling in the buffer transport, while the horizontal axis represents time. The profile begins at point 201, where the above algorithm has determined that the distance to the downstream document is great enough that the maximum acceleration, a, should be applied. For subsequent sample periods, up until point 202 on the motion profile, the distance between documents continues to be sufficiently large that maximum acceleration is applied.

At point 202, the document has reached the maximum velocity, $V_{max}$, and no more acceleration can be applied. For the interval subsequent to point 202, sufficient distance exists between documents that the maximum velocity $V_{max}$ is maintained. At the sample period represented by t' at point 203, the displacement required to decelerate from the current velocity to the velocity of the downstream document has been determined to be equal to, or greater than, the actual distance to the downstream document. The shaded area labeled $X_{decelt}$' represents this displacement that would be required to slow to the velocity Vft'. Thus in accordance, with the rules above, the maximum deceleration, d, is applied by the servo motors M, controlling the document.

After point 203, since the velocity of the document is decreasing, the required deceleration displacement $X_{decelt}$ will also decrease. However, the available room to decelerate will also decrease as the document approaches the downstream document. The document may eventually come to stop, or start to accelerate again. The motion profile is dependent on the movement of the downstream document.

A special circumstance for control of nips N arises for the most downstream group of roller nips in the buffer transport. For that group, there will be no downstream document in the buffer transport from which to determine a motion profile as described above. Rather, transfers of document accumulations to the synchronous inserter chassis transport from that group of nips is based on the synchronous timing and availability of spaces on the synchronous chassis transport.

If the chassis transport is halted for some reason, the most downstream group of roller nips N will be instructed to stop the movement of document accumulations at the end of the buffer transport. Based on the halting of the most downstream document accumulation, the motion control algorithms eventually cause upstream documents to stop at their places within the buffer. By this mechanism, the buffer will fill with the maximum number of parked document accumulations, separated by the predetermined gaps.

Upon the stopping of the synchronous chassis transport, the input modules upstream of the buffer transport may be instructed to cease creation of new document accumulations. Accumulations that were already in progress are parked in the available stations in the buffer and the accumulator. Alternatively, the input modules may continue to create enough document accumulations to fill all of the remaining stopping stations, before being shut down. Under this alternative embodiment, the largest number of document accumulations will be immediately available for transfer to the synchronous transport when the system restarts.

Figure 5:
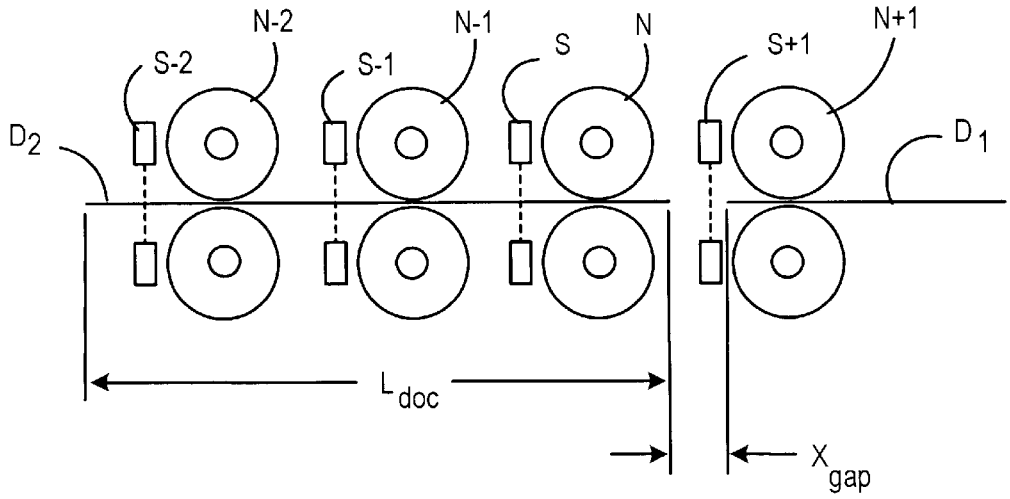
FIG. 5 depicts a preferred embodiment for selecting roller nips to slave together during operation of the buffer transport of the present invention.

The motion control algorithms above apply to a group of roller nips N that are in contact with the document during the sample period. Preferably, the group of roller nips N are slaved together, one of the roller nips N being designated a master, with which the others are required to act in unison. In accordance with the preferred embodiment of the present invention, during each sample period, the controller assesses whether each roller nip N is a master or a slave for that period, and if a slave, which master it follows. At initial start-up, all roller nips N accelerate at maximum acceleration, a, to reach the maximum velocity, $V_{max}$. Subsequently the controller 100 uses the following logic to determine the master-slave relationship, as shown in reference to FIG. 5.

The master-slave relationships are determined as follows:

1) Nip N is initially slaved to nip N−1.
2) Nip N becomes a master when the leading edge of document D2 arrives at then nip N.
3) Nip N becomes a slave to nip N+1 when the lead edge of document D2 reaches nip N+1.
4) Nip N becomes a slave to nip N−1 when the tail edge of document D2 reaches the nip N.

This four-step cycle is repeated for each subsequent document transported by nip N. By applying this algorithm at each sample period, the controller insures that the appropriate nips N are used to control the motion of the document accumulations, while performing the motion profiles previously discussed.

The preferred embodiment of the invention described herein makes more efficient use of space than the prior art system described herein. Also, the positive control provided by the servo controlled nips N eliminates some unreliability that resulted from the prior art system's use of the continuously running o-ring belts.

Although the invention has been described with respect to preferred embodiments thereof, it will be understood by those skilled in the art that the foregoing and various other changes, omissions and deviations in the form and detail thereof may be made without departing from the spirit and scope of this invention.

What is claimed is:

1. A buffer transport system for staging accumulated documents produced by an input module of an inserter system prior to transfer to a downstream synchronous transport for downstream processing in the inserter system, the buffer transport comprising:

a plurality of roller nips in series, the roller nips spaced close enough to transfer minimum length accumulated documents between consecutive roller nips, each of the roller nips driven by an independently controllable motor in communication with a controller;

one or more sensors in communication with the controller, the sensors sensing positions of lead and trail edges of accumulations of documents transported in the buffer transport system;

the controller determining movement of each of the plurality of roller nips for every sampling period in a periodic operating cycle, for each sampling period, and for each roller nip, the controller:

a) slaving the roller nip to a group of slaved roller nips based on which roller nips are needed to control a particular accumulation of documents under its control;

b) controlling motion of the roller nip in accordance with a predetermined algorithm to bring a lead edge of the particular accumulation within a predetermined gap distance from a trail edge of a downstream accumulation of documents in the buffer transport;

and wherein the controller further drives a most downstream group of slaved nips to transfer accumulations of documents to the downstream synchronous transport based on the availability of openings on the synchronous transport.

2. The buffer transport system of claim 1 wherein the controller's slaving of the roller nip in the group of slaved roller nips is determined by the following rules whereby:

i) the roller nip is initially slaved to an immediately upstream roller nip;

ii) the roller nip becomes a master when the lead edge of the particular accumulation of documents arrives at the roller nip;

iii) the roller nip becomes a slave to an immediately downstream roller nip when the lead edge of the particular accumulation of documents arrives at the immediately downstream roller nip; and iv) the roller nip becomes a slave to the immediately upstream roller again when the tail edge of the particular accumulation of documents reaches the roller nip.

3. The buffer transport system of claim 2 wherein the roller nips have a maximum velocity, and the predetermined algorithm to bring the lead edge of the particular accumulation within the predetermined gap distance from the trail edge of the downstream accumulation of documents in the buffer transport operates as follows:

i) the controller subtracting the predetermined gap from an actual sensed gap between the particular accumulation and the downstream accumulation, the resulting difference herein referred to as distance Xt;

ii) the controller calculating a displacement in order to decelerate from a current velocity of the roller nip to a current velocity of the downstream accumulation, the resulting displacement referred to as distance Xdecel;

iii) if Xt is less than, or equal to, Xdecel, and the current velocity of the roller nip is greater than zero, the controller causes the roller nip to decelerate at a predetermined deceleration for the sampling period;

iv) if Xt is greater than Xdecel and the current velocity of the roller nip is less than the maximum velocity, the controller causes the roller nip to accelerate at a predetermined acceleration for the sampling period;

v) otherwise, the controller will cause the current velocity to remain constant for the sampling period.

4. The buffer transport system of claim 1 wherein the roller nips have a maximum velocity, and the predetermined algorithm to bring the lead edge of the particular accumulation within the predetermined gap distance from the trail edge of the downstream accumulation of documents in the buffer transport operates as follows:

i) the controller subtracting the predetermined gap from an actual sensed gap between the particular accumulation and the downstream accumulation, the resulting difference herein referred to as distance Xt;

ii) the controller calculating a displacement in order to decelerate from a current velocity of the roller nip to a current velocity of the downstream accumulation, the resulting displacement referred to as distance Xdecel;

iii) if Xt is less than, or equal to, Xdecel, and the current velocity of the roller nip is greater than zero, the controller causes the roller nip to decelerate at a predetermined deceleration for the sampling period;

iv) if Xt is greater than Xdecel and the current velocity of the roller nip is less than the maximum velocity, the controller causes the roller nip to accelerate at a predetermined acceleration for the sampling period;

v) otherwise, the controller will cause the current velocity to remain constant for the sampling period.

5. The buffer transport system of claim 1 wherein the plurality of roller nips are spaced a uniform distance apart.

6. The buffer transport system of claim 5 wherein one or more sensors are a plurality of sensors arranged such that at least one sensor located within the uniform distance between consecutive roller nips.

7. The buffer transport system of claim 1 wherein a number of stations in the buffer transport is determined by a length of the buffer transport divided by a sum of a length of documents to be processed and the predetermined gap, and the controller instructs the input module to stop creation of new accumulations of documents when a quantity of accumulations in the buffer transport and already in production by the input module equals the number of stations.

8. The buffer transport system of claim 1 wherein the sensors are optical sensors.

9. The buffer transport system of claim 1 wherein the independently controllable motors include encoders providing signals to the controller representing the displacement of the nip rollers and wherein the controller determines locations of accumulations of documents at a given time based on positions sensed by the sensors further supplemented by the subsequent displacements indicated by the encoder signals.

10. The buffer transport system of claim 9 wherein the controller controls the movement of the roller nips by commanding a roller nip displacement for the sampling period corresponding motion requirements calculated for the sampling period.

11. A method for controlling a flow of document accumulations in a buffer transport system for staging accumulated documents produced by an input module of an inserter system prior to transfer to a downstream synchronous transport for downstream processing in the inserter system, the buffer transport comprising a plurality of roller nips in series, the method including:

driving each of the roller nips driven by an independently controllable motor;

determining movement of each of the plurality of roller nips for every sampling period in a periodic operating cycle, further including sub steps in each sampling period, and for each roller nip for:

a) slaving the roller nip to a group of slaved roller nips based on which roller nips are needed to control a particular accumulation of documents under its control;

b) controlling motion of the roller nip in accordance with a predetermined algorithm to bring a lead edge of the particular accumulation within a predetermined gap distance from a trail edge of a downstream accumulation of documents in the buffer transport; and driving a most downstream group of slaved nips to transfer accumulations of documents to the downstream synchronous transport based on the availability of openings on the synchronous transport.

12. The method of claim 11 wherein the step of slaving the roller nip in the group of slaved roller nips is determined by:

i) initially slaving the roller nip to an immediately upstream roller nip;

ii) making the roller nip a master when the lead edge of the particular accumulation of documents arrives at the roller nip;

iii) slaving the roller nip to an immediately downstream roller nip when the lead edge of the particular accumulation of documents arrives at the immediately downstream roller nip; and iv) slaving the roller nip to the immediately upstream roller again when the tail edge of the particular accumulation of documents reaches the roller nip.

13. The method of claim 12 wherein the roller nips have a maximum velocity, and the predetermined algorithm includes the following steps:

i) subtracting the predetermined gap from an actual gap between the particular accumulation and the downstream accumulation, the resulting difference herein referred to as distance Xt;

ii) calculating a displacement in order to decelerate from a current velocity of the roller nip to a current velocity of the downstream accumulation, the resulting displacement referred to as distance Xdecel;

iii) if Xt is less than, or equal to, Xdecel, and the current velocity of the roller nip is greater than zero, decelerating the roller nip at a predetermined deceleration for the sampling period;

iv) if Xt is greater than Xdecel and the current velocity of the roller nip is less than the maximum velocity, accelerating the roller nip at a predetermined acceleration for the sampling period;

v) otherwise, maintaining the current velocity for the sampling period.

14. The method of claim 11 wherein the roller nips have a maximum velocity, and the predetermined algorithm includes the following steps:

i) subtracting the predetermined gap from an actual gap between the particular accumulation and the downstream accumulation, the resulting difference herein referred to as distance Xt; ii) calculating a displacement in order to decelerate from a current velocity of the roller nip to a current velocity of the downstream accumulation, the resulting displacement referred to as distance Xdecel;

iii) if Xt is less than, or equal to, Xdecel, and the current velocity of the roller nip is greater than zero, decelerating the roller nip at a predetermined deceleration for the sampling period;

iv) if Xt is greater than Xdecel and the current velocity of the roller nip is less than the maximum velocity, accelerating the roller nip at a predetermined acceleration for the sampling period;

v) otherwise, maintaining the current velocity for the sampling period.

15. The method of claim 11 wherein the roller nips are spaced a uniform distance apart and further including the step of determining a number of stations in the buffer transport by dividing a length of the buffer transport by a sum of a length of documents to be processed and the predetermined gap, and the method further includes instructing the input module to stop creation of new accumulations of documents when a quantity of accumulations in the buffer transport and already in production by the input module equals the number of stations.

16. The method of claim 11 further including the steps of providing signals from encoders on the roller nips to the controller representing displacement of the nip rollers sensing locations of accumulations in the buffer transport as a function of the signals from the encoders.

17. The method of claim 16 wherein the step of sensing further includes sensing the location of accumulations using optical sensors supplemented by displacements represented by the encoder signals.

18. The method of claim 17 further including the step of commanding roller nip displacement for the sampling period for corresponding motion requirements calculated for the sampling period.

* * * * *